US005799333A

United States Patent [19]

McGarry et al.

[11] Patent Number: 5,799,333

[45] Date of Patent: Sep. 1, 1998

[54] GLOVE LINER HAVING AN AMBIDEXTREOUS AND UNIVERSAL SIZE

[75] Inventors: Joseph D. McGarry; Tilak M. Shah, both of Cary, N.C.

[73] Assignee: Polygenex International, Inc., Cary, N.C.

[21] Appl. No.: 477,606

[22] Filed: Jun. 7, 1995

Related U.S. Application Data

[63] Continuation-in-part of Ser. No. 228,907, Apr. 18, 1994, abandoned, which is a continuation of Ser. No. 765,979, Sep. 26, 1991, abandoned.

[51] Int. Cl.[6] ..... A41D 19/00

[52] U.S. Cl. ..... 2/161.6; 2/167; 66/202

[58] Field of Search ..... 2/16, 161.6, 161.7, 2/164, 167, 168; 66/202, 174

[56] References Cited

U.S. PATENT DOCUMENTS

| | | | |
|---|---|---|---|
| 2,441,611 | 5/1948 | Ackerman | 66/174 |
| 3,596,134 | 7/1971 | Burke | 2/167 |
| 4,463,156 | 7/1984 | McGary, Jr. et al. | 2/167 |
| 4,470,251 | 9/1984 | Bettcher | 2/167 |
| 4,590,627 | 5/1986 | Connely | 2/167 |
| 4,769,856 | 9/1988 | Reed | 2/167 X |
| 4,785,479 | 11/1988 | Wananabe | 2/167 X |
| 4,864,661 | 9/1989 | Gimbel | 2/167 |
| 4,869,951 | 9/1989 | McCullough, Jr. | 28/247 X |
| 5,062,161 | 11/1991 | Sutton | 2/169 |
| 5,070,540 | 12/1991 | Bettcher et al. | 2/167 |

OTHER PUBLICATIONS

Textile, Yarns Tecnology Structure and Application, Goswami et al., John Wiley and Sons, Inc. New York, Dec. 1977.

Encyclopedia of textiles Fibers and Nonwoven Fasbrics, Grayson, John Wiley and Sons, Inc., New York, Dec. 1984.

*Primary Examiner*—C. D. Crowder
*Assistant Examiner*—Larry O. Worrell, Jr.
*Attorney, Agent, or Firm*—Waldron & Associates

[57] ABSTRACT

A seamless knitted glove with a cuff having an ambidextrous and universal size made from crimped and textured stretchable continuous filament nylon yarn of four ply of about 70 deniers or less. Also, a method of making a seamless knitted glove with a cuff having an ambidextrous and universal size comprising the steps of knitting an eight and a half inch to nine inch glove using crimped and textured stretchable continuous filament nylon yarn of four ply of about 70 deniers or less with a 13 gage knitting machine, heat shrinking the glove to less than seven inches, and heat stretching the glove to about seven inches.

22 Claims, 1 Drawing Sheet

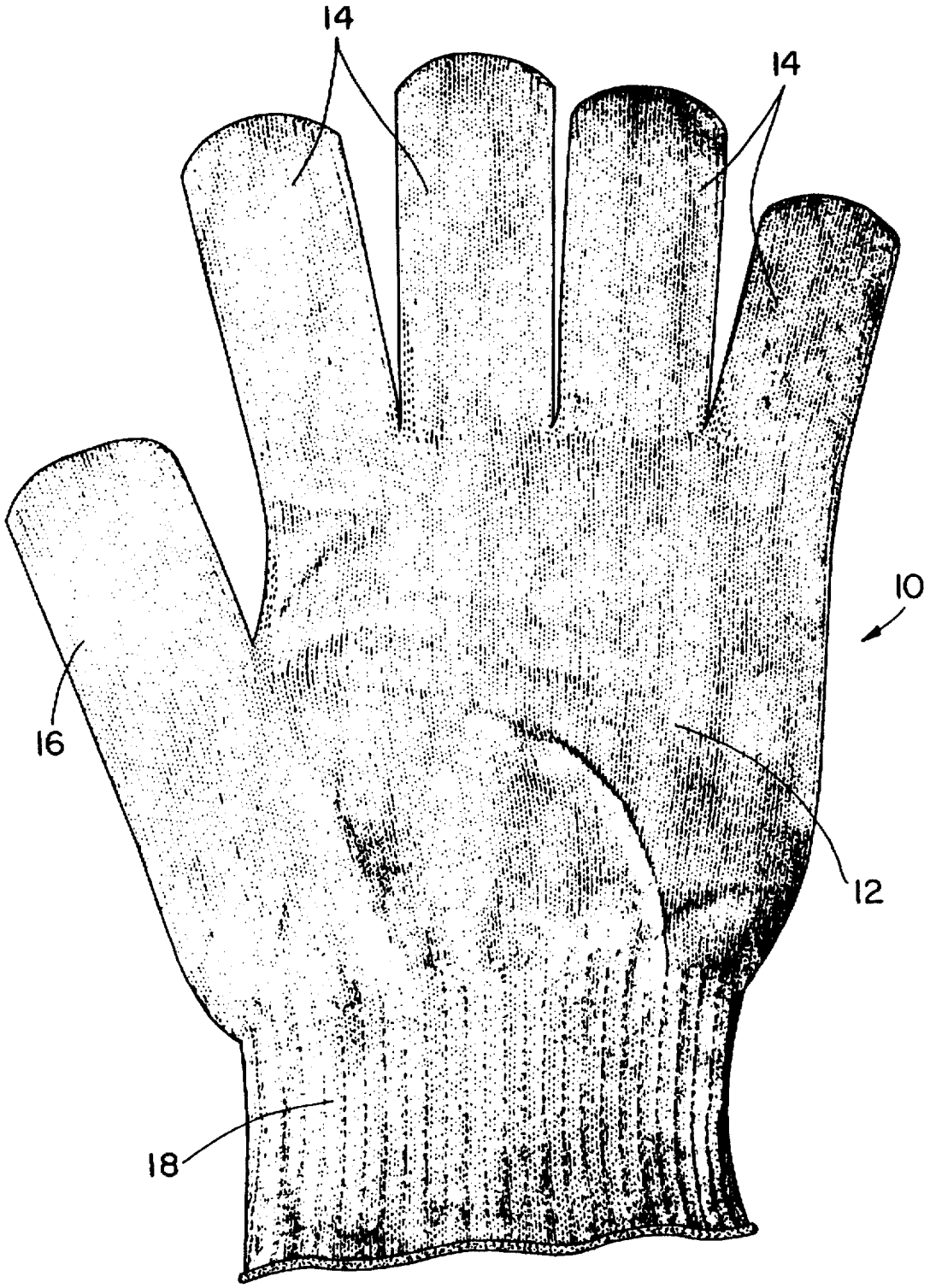
14
14
10
16
12
18

GLOVE LINER HAVING AN AMBIDEXTREOUS AND UNIVERSAL SIZE

This application is a Continuation-in-Part of Applicant's prior co-pending application, Ser. No. 08/228,907, filed Apr. 18, 1994, now abandoned, which is a continuation of Ser. No. 07/765,979, filed Sep. 26, 1991, and now abandoned.

BACKGROUND OF THE INVENTION

1. Field of the Invention:

This invention relates to a thin and close fitting seamless knitted glove with a cuff having a ambidextrous and universal size and more particularly to a glove or glove liner made from crimped and textured stretchable continuous filament nylon yarn of about 300 denier, preferably up to about four ply of 70 denier or less. This invention also relates to a method of making a seamless knitted glove with a cuff having an ambidextrous and universal size comprising the steps of knitting an oversized glove, heat shrinking the glove, and heat stretching the glove to a uniform nominal size.

2. The Prior Art.

Gloves or glove liners are manufactured from yams containing fibers of various deniers by textile weaving or knitting processes. Depending on the ultimate use of the glove or liner, various treatments may be used on either the yarn or the final product. These gloves are typically made of natural fibers such as cotton, synthetic fibers or natural and synthetic fiber mixes. Natural fiber and mixed fiber knitted or woven gloves have a major drawback in that as lint or dust-like particles.

In the photoprocessing industry, knitted cotton gloves are often used when handling films, negatives and prints. However the harsh cotton can cause scratches, form static electricity and leave dust and lint on the material being handled. Rubber or latex gloves avoid these problems but at the expense of tactile sensation. In addition rubber or latex gloves are less flexible which hinders dexterity. Furthermore, rubber or latex gloves cause uncomfortable perspiration and clamminess.

The uses of protective gloves for a wide variety of purposes has increased significantly in recent years. Protective gloves are especially important in the medical field where contact with infectious agents is a daily risk. Contact with human blood is particularly undesirable in view of the severity of blood- transmissible diseases such as hepatitis and AIDS (acquired immune deficiency syndrome). Gloves appropriate for the medical setting require a high degree of fluid/air impermeability. However, trapped moisture generated by perspiration results in hand irritation, discomfort and decreased manual dexterity. Another undesirable characteristic of fluid/air impermeable gloves is that the gloves can cause an adverse skin reaction by the wearer. A significant proportion, estimated at 7 to 10% of all surgeons and medical personnel suffer from some type of dermatitis caused by an allergy or sensitivity to vulcanized natural rubber, commonly referred to as "latex" gloves.

Due to the necessary skin tight fit and the nature of vulcanized natural rubber, dry lubricants such as talc have been used to permit medical gloves, especially surgical gloves, to be readily placed on and removed from the hands of the wearer. Unfortunately, talc has been known to irritate skin and thereby aggravate the dermatitis problem associated with rubber gloves.

Gray, U.S. Pat. No. 5,014,361 discloses one approach taken to overcoming the disadvantages of the use of rubber gloves in the medical setting, namely the manufacturing of hypo-allergenic polyurethane elastic gloves. A similar approach is found in McGarry, Jr. et. al, U.S. Pat. No. 4,463,156 which also discloses the manufacture of hypo-allergenic surgical gloves from polyurethane elastomers. However, these gloves do not overcome the problems associated with moisture generation that causes discomfort and decreased manual dexterity. In attempt to absorb moisture and improve the comfort level, rubber gloves are sometimes worn with liners.

Hsuih, U.S. Pat. No. 4,947,486 discloses a tubular shaped glove liner designed to be worn with rubber gloves which cover the palm and part of the fingers, leaving the finger tips free to avoid the numbing of tactile sensation and loss of dexterity associated with liners. The liner can be manufactured from wool, acrylic, or blended yarn, but most preferably 100% cotton.

Other glove liners, typically cotton, are available on the market. However, currently available knitted glove liners are produced in fixed sizes. Standard sizes are small, medium and large. Sometimes the liners are available in male and female sizes as well. Most come as a pair requiring that the one stock both a right and left hand glove liner in each size and sex. Keeping a full range of gloves in stock is expensive, inconvenient and not well suited to fit the full range of hand sizes. Furthermore, as these liners seldom fit well, they make it difficult to put on and take off tight fitting rubber or latex gloves. A further disadvantage of the currently available glove liners is their excess bulk. Although they absorb moisture, they interfere with tactile sensitivity, flexibility and dexterity.

In some industrial settings, the need for fluid/air tight gloves is not as demanding. For these situations, moisture permeable polyurethane resins and polymer gloves have been developed. See Ishiwata U.S. Pat. No. 4,670,330 and Suzuki et al., U.S. Pat. No. 4,783,857. However, these gloves suffer to some degree from the drawbacks associated with fluid/air impermeable gloves. Furthermore, these gloves suffer from the loss of overall strength and tear resistance.

Knit gloves of blended synthetic yarn are available. The gloves are made from nylon and polybutylacetate and consequently can not be autoclaved or cold sterilized.

In some industrial settings, such as the computer industry, it is desirable or necessary to reduce the accumulation of static charges on the clothes or gloves of people working with computers or electronic products. Static discharge can causes damage to the circuitry of computers, computer components or any electric components that are being handled. Extensive efforts to reduce static discharge include the wearing of electro-conductive clothing including gloves. McCullogh, Jr. et al, U.S. Pat. No. 4,869,951 discloses the manufacturing of cloth containing carbonaceous filament or fiber. However, carbon fibers poses a health risk as well as a potential source of conductive dust and lint that could be as damaging as any static discharge.

Another solutions is to ground workers to the work bench using wrist straps and ground wires connected to the wrist straps. When the worker needs to move, they disconnect them selves form the bench. However, this type of grounding severely limits the mobility and flexibility of the workers. Furthermore, when disconnected, it can be a hazard and inconvenience walking around with dangling ground wires.

Given high levels of electrical conductivity, conductive articles are useful as body contact electrodes for use in electrical muscle stimulation (EMS), t* transdermal electrical neural stimulation (TENS), pulsed current bone growth stimulation, pulsed d.c. current flow induction, as electrodes for body electrical signal detectors, such as EEG and EKG, and like biomedical and bioelectrical uses. In any usage where high electrical conductivity in conductive contact with the skin is required, a body contact electrode is required.

In view of the above considerations, there is a need for a glove or glove liner which is tight fitting and thin, dust and lint free, water absorbent, reduces allergic reactions from rubber gloves, is a universal size and ambidextrous and optionally possess anti-static, static dissipating and/or electrically conductive characteristics.

SUMMARY OF THE INVENTION

It is a principal object of the present invention to overcome the above cited disadvantages of knitted gloves and glove liners.

It is an additional object of the present invention to provide a lint and dust free glove for film handling which eliminates fingerprints and scratches.

Another object of the present invention is to provide a glove or glove liner that is dose fitting, thin, seamless, ambidextrous and a universal size (one size fits all).

A further object of the present invention is to provide a glove or glove liner that reduces perspiration and clamminess.

It is yet another object of the present invention to provide a glove or glove liner that is economical, reusable, washable, dry cleanable, autoclavable and comfortable enough to be worn for prolonged periods.

It still a further object of the present invention to provide a static dissipative glove that is comfortable, eliminates static build-up, eliminates the need for a wrist strap and is economical to use.

Still another object is the provision of electrically conductive gloves suitable for use as skin contact electrodes for use in TENS, EMS, electrical bone growth stimulation, and related biomedical uses.

These and other objects of the present invention are attained in a glove or glove liner of about 70 deniers or less, manufactured using a continuous filament textured nylon yarn which has been crimped such that it can be stretched between 300 to 500 percent.

Seamless knitted gloves made in accordance with the present invention are better than cotton or woven gloves, comfortable, low bulk, dust and lint free, and economical.

BRIEF DESCRIPTION OF THE DRAWINGS

FIG. 1 is a stylized illustration of a knit glove in accordance with the present invention illustrating the structure and parts thereof.

DETAILED DESCRIPTION

The glove or glove liners of the present invention are made from a continuous filament synthetic yarn, preferably nylon, most preferably nylon 6/6. As disclosed in Rhash, U.S. Pat. No. 4,196,574, although synthetic yarns lack the aesthetic qualities existing in natural fibers, thermoplastic continuous filament polymeric yarn, such as nylon, polyester and the like, offer better processing and uniformity than natural fibers. Additionally, polymeric yarns form less dust or lint than natural fiber yarns such as cotton.

Synthetic yarns of the present invention, such as nylon, are considered to be "lively" yarns, in that they have a tendency to contract and twist due to the "live" torque in the yarn. Torque can be introduced into or increased in synthetic yarns by twisting or crimping the yarn into "Z" twists or "S" twists. The yarn can also be bulked or texturized. Texturized or bulked continuous filament synthetic yarn may be highly contractible and stretchable. Suitable yarns include nylon 6, nylon 6/6, polyester, (such as polybutylene terephthalate, and polyethylene terephthalate), polypropylene, and cellulose acetate. The preferred synthetic yarn of the present invention is nylon 6/6. Nylon is a relatively strong synthetic yarn, with low friction and has the necessary ability to form and retain the crimps, twists, contractions and coils of the present invention.

Many thermoplastic polymers, such as synthetic yarns, also exhibit considerable plastic "memory". That is, the yarns can be stretched out of shape, heated, re-stretched, reheated and still return to their original shape. As disclosed in Brenner et al., U.S. Pat. No. 4,193,899, this polymeric feature is based on chemically covalent crosslinking that provides permanent restoring forces. This is also disclosed in Ueno, U.S. Pat. No. 4,820,782 as "thermal recovery property". This polymeric feature is an important feature of the present invention.

These lively, stretchable yarns have been known and used for some time in making processed (knitted or woven) goods, but their use is not without shortcomings. As disclosed in Kramers, U.S. Pat. No. 4,554,121, elastic yarns require special equipment for processing the yarn into goods and are frequently formed into a 2 ply yarn using one relatively inelastic yarn coupled with an elastic yarn. The present invention uses a 2 ply co-twisted yarn made of an "S" twist and a "Z" twist of the same textured continuous filament material, such as nylon 6/6. This unique two ply yarn has a 300 to 500% elongation capacity. The gloves or glove liners of the present invention are preferably knitted using a special knitting machine with 13 gage needles providing 13 courses per inch. The machine is a 73 to 88 needle machine. Gloves or liners made in this manner have a 300 to 500% elongation capacity, an important feature of the present invention.

The glove or glove liner of the present invention is made from a continuous filament crimped and textured stretchable yarn using various yarn sizes. For gloves to be used in photoprocessing labs for example the yarn size should be no more than four ply 70 deniers , preferably 30 to 50, most preferably about 40. A glove made using about 70 deniers will be less than 15 mils thick. This thin, low bulk feature of the glove provides an important feature of the present invention. This feature is particularly important for glove liners, especially liners to be used under surgical gloves, and other usage where tactile dexterity is essential.

In another contexts, the major benefits of the present invention are still available employing yarns of up to as much as 300 denier, producing a much thicker knit fabric. Such heavier knits may be desirable when exposure to cold weather or other low temperature uses are encountered.

In addition to fingers and a hand portion, the glove includes a cuff, preferably an elongated cuff. By extending the cuff length the glove is held more securely to the wrist. The cuff can also be manufactured to include extra synthetic yarn such as Spandex elastomeric yarn. The cuff provides extra hold and comfort. The knit is preferably terminated with one or more courses of a heat shrink yarn co-twisted with the nylon 6/6 yarn. The heat shrink yarn serves to seal the edge of the knit and to stabilize the structure.

The glove or liner is preferably single knit, using up to four ply 70 denier yarn or less, on the knitting machine. The glove is typically knit to an oversize of about 8½ to 9 inches, desirably at 10 stitches per inch or more, preferably 12 stitches per inch or more. We particularly prefer to employ 13 stitches per inch. Such a fine knit is important to glove liners, to prevent direct contact between the skin of the wearer and a latex or other overglove. The fineness of the knit, in combination with the fineness of the yarns employed provide a thin knit which maximizes tactical sensation and dexterity for the wearer, while still affording good barrier separation of the skin from the overglove. The glove is then washed and/or scoured and shrunk to less than 7 inches. The glove can alternatively be dry cleaned and/or heat dried and shrunk at a range of 120 to 180 F., preferably 150 F. Next the glove is heat stretched to about 7 inches. The glove may be further treated to add or improve other characteristics such as absorbance and anti-static features of the glove or liner. This process relies on the plastic "memory" characteristic of the synthetic yarn to provide a tight fitting glove that can be stretched out to fit all sizes (universal size) and allows for an ambidextrous knit. The gloves of the present invention, when so formed, can be stretched up to 300% without permanent deformation, allowing the glove to fit hands of all sizes and be reused. Furthermore, the glove can be washed, autoclaved, dry cleaned and still retain its shape. As yet another feature, the glove freely stretches and contracts as the hand is moved inside the glove, making for a comfortable glove. These too are important features of the present invention.

It is also important to the present invention and most uses for the gloves and glove liners disclosed herein that the finger cots and thumb cot of the gloves and liners are integrally knit, and the gloves do not comprise any separate or separable component parts stitched together, as is common to many gloves and glove liners. Stitched gloves have limited stretch properties, and impose a requirement for gloves of a variety of sizes.

To be ambidextrous, the thumb cot must be symmetrically formed and placed, as those of ordinary skill in the art will understand.

The synthetic yarn used in making the glove or liner is a multifilament yarn of 1 to 3 denier per filament, which has been texturized. This characteristic provides a large surface area which can absorb up to 5% by weight of the yarn moisture. Furthermore, wetting agents can be added to the glove or liner which improve moisture absorption. Anionic surfactants or pH balanced soaps can be used to coat the glove or glove liner. Preferably the anionic surfactants such as those available from Sandoz under the trademarks SANDOP MS-40 or SANDOP DTC. The basic chemical structure of the compounds is:

$$R—[OCH_2—CH_2]_n—CH_2CO_2Na$$

wherein:

for SANDOP MS-40, R=nonylphenyl and n=20, while for SANDOP DTC, R=tridecyl and n=7.

Any pH balanced soap will also work. This particularly useful in medical applications. It is important to wash the glove for health reasons and equally useful to help improved moisture absorption for glove liner under fluid/air impermeable rubber or latex gloves.

Anti-static properties can be increased depending on the needs of the wearer, by either treating the glove or liner with anti-static compounds or preferably by adding conductive yarn to the glove while the glove is being knitted. Examples of antistatic compounds that can be added to polymers or coated on polymers are disclosed in McCullough, Jr. et al, U.S. Pat. No. 4,869,951; Wozniak U.S. Pat. No. 4,906,681; and deGaravilla, U.S. Pat. No. 5,037,875.

Static dissipative properties are preferably achieved by adding increasing percentages of conductive yarn into the synthetic yarn before knitting the glove. Various types of conductive yarn can be used. In particular, yarns with internal conductivity can be used such as yarn containing conductive carbon fiber; yarn containing metal fiber; and yarn containing copper sulfate. In addition yarn containing fibers of conductive metal or fibers coated with conductive metal such as silver or aluminum can also be used. It is preferable to use silver coated multifilament nylon yarn which can be obtained from Sauquoit Industries, called X-Static® conductive yarn. It is also effective to use copper sulfate impregnated nylon yarn which can be obtained from Nippon Sanmo Dyeing Co. Ltd., called Thunderon SSN. A yarn of conductive carbon encapsulated in nylon polyamide is available from dupont under the trademark Nega-Stat® conductive yarn. Stainless steel fibers suitable for use are available from the Fluid Dynamics Division of Memtec America Corporation, Deland, Fla. By using these conductive yarns static electricity can be greatly reduced or eliminated.

The conductive yarns may be employed alone or may be co-twisted with another, nonconductive yarn to produce a two-ply composite yarn. In such cases, properties intermediate to those of the component yarns is normally obtained. In particular, the conductive yarn may be a crimped and textured stretchable continuous filament nylon yarn of about 150 denier or less wherein the yarn contains at least one electrically conductive fiber which is a member selected from the group consisting of conductive carbon fiber, metal fiber, yarn coated with conductive metal, copper sulfate impregnated nylon, and blends thereof. Multi-ply composite yarns are known to those of ordinary levels of skill in the art, and the technique for the formation thereof are not per se a part of the present invention.

Conductivity in the glove fibers can be very high and if a surface, material or body is charged with static electricity, it will have an electric field emanating from it. In most situations this electric field will be perpendicular to the glove surface. As the diameter of each conductive filament in the glove is very small, it forms a sharp point at the fiber edge compared to the other conductive surfaces near or surrounding it. These sharp fiber edges will provide a point where all the static charges concentrate and generate ions. The ions will start to ionize in the air by corona discharge and neutralize any static charge in the glove. This process will continue until the field has been reduced to the point where ionization stops and static electricity is practically eliminated or rendered harmless. In gloves or liners which rely on corona discharge to dissipate static electricity it is effective to use 8 to 30 percent copper sulfate impregnated nylon.

In the present invention the glove can also be grounded by connecting a ground wire to the cuff. In situations where the glove is to be grounded, it is preferable to use about 5 to 12% silver coated nylon in the glove and optionally 12 to 15% silver coated nylon in the cuff. The cuff edge can also be oversewn with either silver coated nylon or copper sulfate impregnated nylon. The ground wire can be attached to work area. When a worker approaches the area, the ground wire is hooked to the cuff using a clip, such as an alligator clip. This avoids the limitations of permanent ground wires and the hazards of dangling ground wires connected to the gloves of workers as they move about.

Using these conductive yarns the surface resistivity of the glove or liner is less than $10^4$ ohm-square, generally between $10^3$ to $10^6$ ohm-square and where a cuff is formed, the cuff has a resistivity of between $10^2$ to $10^6$ ohm-square, generally $<10^4$, preferably $<10^3$ ohm-square.

These gloves are lint and dust free, anti-static, thin and close fitting reduce perspiration and clamminess, and eliminate fingerprints and scratches. They are ambidextrous, a universal size, sensitive, flexible, dexterous and low bulk. These gloves can be reused, washed and worn in comfort for prolonged periods. The elastic cuff adds to the comfort of the glove and the absence of seams eliminates catches.

The gloves or liners made according to the present invention provide a very important feature, especially in medical settings; namely, they can be cold sterilized and/or autoclaved. This feature allows the glove to be used repeatedly with great savings and convenience. Furthermore, the ability to cold sterilize and autoclave the gloves allows for their use in environments, such as surgical field, where dexterity, comfort, safety, and economy are crucial.

Autoclaving requires that the glove withstand temperatures of at least 100° C. for a time of at least 40 minutes or more or, in the alternative, a temperature of at least 140° C. for a time of at least 10 minutes or more. These are demanding conditions for textile fibers and yarns and for fabrics and knit articles formed of textile fibers. The gloves and glove liners of the present invention withstand such conditions without degradation or difficulty.

Glove liners made according to the present invention provide a barrier to latex, rubber or plastic contact which reduces allergic reactions and rashes as glove liners. The liners eliminate the need for powder or-powdered gloves. They facilitate the easy slip on and removal of all types of gloves. The liners keep the inside of over-gloves clean and eliminate odors. They can be sterilized in an autoclave or easily washed in soap and water.

Glove or liners made according to the present invention with static dissipative conductive yarn reduce or eliminate static build-up. The gloves or liners have a uniform resistivity throughout the entire glove, with an average surface resistivity of $2\times10^3$ ohm-square with a static decay of 5 KV to 0 V in less than 0.1 second. The gloves eliminate the need for wrist straps. The gloves can be grounded by clipping a ground strap to the wrist strap should the need arise.

In biomedical and bioelectrical fields, even higher conductivity is desirable. Gloves (as well as socks, sleeves, arm bands, wraps, caps, and the like) knit and formed in accordance with the present invention entirely of highly conductive forms of yarns mentioned above are suitable for such use. Such structures, in addition to the properties already described, will have high levels of conductivity and close conformity to the shape and contact with the body, suited to use as electrodes for contact with the skin, and will readily transmit electrical signals to the body. While any conductive yarn may be employed, we particularly prefer to use the silver plated nylon fiber X-Static® conductive yarn available from Sauquoit Industries, Inc., of Scranton, PA. X-Static® conductive yarn yarns are readily crimped or otherwise bulked, and have no impregnated or bonded materials which can slough off the surface of the fibers in use and are generally more durable than other forms of conductive yarn. We prefer, too, that the gloves, or other comparable structures, be formed entirely of the X-Static® conductive yarn yarn to maximize electrical conductity.

EXAMPLES

Example 1

A glove corresponding to FIG. 1 was knit, of nylon 6/6 yarn four ply of 40 denier, on a thirteen gage knitting machine with 13 gage needles. The glove body (12), finger cot portions (14) and the thumb cot portion (16) were single ply knit. The cuff portion (18) of the glove was double knit in a ribbed pattern of the same yarn co-twisted with a strand of Spandex elastomeric yarn. The knit was terminated with a double course of a shrink yarn co-twisted with the nylon 6/6 yarn (not shown).

The glove was washed and hot air dried, whereupon it shrank to about one-half its original size as knit. The washed glove was then stretched, formed and heat set.

Example 2

A glove corresponding to FIG. 1 was knit, of nylon 6/6 yarn of four ply 30 denier having an S-twist co-twisted with the same yarn having a Z-twist, on a thirteen gage knitting machine with 13 gage needles. The glove body (12), finger cot portions (14) and the thumb cot portion (16) were single ply knit. The cuff portion (18) of the glove was double knit in a ribbed pattern of the same yarn co-twisted with a strand of Spandex elastomeric yarn. The knit was terminated with a double course of a shrink yarn co-twisted with the nylon 6/6 yarn (not shown).

The glove was washed and hot air dried, whereupon it shrank to about one-half its original size as knit. The washed glove was then stretched, formed and heat set.

Example 3

A glove corresponding to FIG. 1 was knit, of nylon 6/6 yarn of two ply 40 denier co-twisted with two ply 40 denier X-Static® conductive yarn, on a thirteen gage knitting machine with 13 gage needles. The glove body (12), finger cot portions (14) and the thumb cot portion (16) were single ply knit. The cuff portion (18) of the glove was double knit in a ribbed pattern of the same yarn co-twisted with a strand of Spandex elastomeric yarn. The knit was terminated with a double course of a shrink yarn co-twisted with the nylon 6/6 yarn (not shown).

The glove was washed and hot air dried, whereupon it shrank to about one-half its original size as knit. The washed glove was then stretched, formed and heat set. The glove had a surface resistivity of $2\times10^3$ ohm-square with a static decay of 5 KV to 0 V in less than 0.1 second.

Example 4

A glove corresponding to FIG. 1 was knit, of nylon 6/6 yarn of four ply 40 denier co-twisted with Thunderon yarn of 30 denier, on a thirteen gage knitting machine with 13 gage needles. The glove body (12), finger cot portions (14) and the thumb cot portion (16) were single ply knit. The cuff portion (18) of the glove was double knit in a ribbed pattern of the same yarn co-twisted with a strand of Spandex elastomeric yarn. The knit was terminated with a double course of a shrink yarn co-twisted with the nylon 6/6 yarn (not shown).

The glove was washed and hot air dried, whereupon it shrank to about one-half its original size as knit. The washed glove was then stretched, formed and heat set. The glove had a surface resistivity of $4.5\times10^2$ ohm-square with a static decay of 5 KV to 0 V in less than 0.1 second.

Example 5

A glove corresponding to FIG. 1 was knit with four ply 50 denier X-Static® conductive yarn on a thirteen gage knitting machine with 13 gage needles. The glove body (12), finger cot portions (14) and the thumb cot portion (16) were single ply knit. The cuff portion (18) of the glove was double knit in a ribbed pattern of the same yarn co-twisted with a strand of Spandex®elastomeric yarn. The knit was terminated with a double course of a shrink yarn co-twisted with the nylon 6/6 yarn (not shown).

The glove was washed and hot air dried, whereupon it shrank to about one-half its original size as knit. The washed glove was then stretched, formed and heat set. The glove had a surface resistivity of 35 ohm-square.

While the above description is limited to the particular uses of the inventive material, it should be apparent that other applications and combinations could be made without departing from the spirit of the invention.

What is claimed is:

1. A seamless knitted glove with a cuff having an ambidextrous shape and stretchable up to at least about 300%, of a crimped and textured stretchable continuous filament nylon yarn of about 300 denier or less, said yarn comprising a twisted yarn of at least two plies wherein at least one ply is formed in a S twist, at least a second ply is formed in a Z twist and said plies are co-twisted together.

2. The glove or claim 1 wherein the yarn is four plies of between 20 to 70 denier.

3. The glove or claim 1 wherein the yarn is four plies of between 30 to 50 denier.

4. The glove of claim 1 wherein the yarn is four plies of about 40 denier.

5. The glove of claim 1 having at least about 10 courses per inch.

6. The glove of claim 1 having at least about 12 courses per inch.

7. The glove of claim 1 having about 13 courses per inch.

8. The glove of claim 1 wherein said yarn comprises a multifilament yarn comprising about 1 to 3 denier per filament providing a surface area sufficient to absorb moisture up to 5 percent by weight of the yarn.

9. The glove of claim 1 further comprising a coating of a wetting agent selected from the group consisting of anionic surfactants and pH balanced soaps on the surface of the fibers of said yarn.

10. The glove of claim 1 further comprising an elastomeric yarn in the knitted cuff in an amount sufficient to comfortably hold the glove on a wrist.

11. The glove of claim 1 further comprising conductive yarn in an amount sufficient to reduce static electricity.

12. The glove of claim 1 wherein said yarn contains an electrically conductive fiber which is a member selected from the group consisting of conductive carbon fiber, metal fiber, yarn coated with conductive metal and copper sulfate impregnant, and blends thereof.

13. The glove of claim 1 wherein 5 to 12 percent of said yarn is coated with conductive metal.

14. The glove of claim 13 wherein 5 to 12 percent of said yarn is silver coated multifilament nylon yarn.

15. The glove of claim 14 wherein 12 to 15 percent of the yarn in the cuff is silver coated multifilament nylon yarn.

16. An electrically conductive seamless knitted glove with a cuff having an ambidextrous shape and stretchable up to at least about 300%, of a crimped and textured stretchable continuous filament nylon yarn of about 300 denier or less wherein said yarn contains at least one electrically conductive fiber which is a member selected from the group consisting of conductive carbon fiber, metal fiber, yarn coated with conductive metal, copper sulfate impregnated nylon, and blends thereof.

17. The glove of claim 16 comprising a surface resistivity of less than $10^4$ ohm square.

18. The glove of claim 16 comprising 5 to 12 percent conductive yarn and further comprising a ground wire.

19. The glove of claim 16 wherein the glove has a surface resistivity of between $10^3$ to $10^6$ ohm square.

20. The glove of claim 16 wherein the cuff has a surface resistivity of between $10^2$ to $10^6$ ohm square.

21. A seamless knitted glove with d cuff having an ambidextrous shape and stretchable up to at least about 300%, of a crimped and textured stretchable continuous filament nylon yarn of about 300 denier or less and wherein at least about 5 percent of said filaments are coated with conductive silver.

22. The glove of claim 20 wherein 8 to 30 percent of said yarn is copper sulfate impregnated yarn.

* * * * *